US006510789B2

(12) United States Patent
Ishikawa

(10) Patent No.: US 6,510,789 B2
(45) Date of Patent: Jan. 28, 2003

(54) STENCIL PRINTING MACHINE AND METHOD FOR PRINTING IN ONE-SIDED AND TWO-SIDED PRINTING MODES

(75) Inventor: Makoto Ishikawa, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/964,468

(22) Filed: Sep. 28, 2001

(65) Prior Publication Data

US 2002/0038607 A1 Apr. 4, 2002

(30) Foreign Application Priority Data

Oct. 2, 2000 (JP) ..... 2000-302473

(51) Int. Cl.[7] ..... B41L 13/06

(52) U.S. Cl. ..... 101/118; 101/116; 101/129; 101/184

(58) Field of Search ..... 101/114, 115, 101/116, 117, 118, 119, 120, 126, 129, 483, 484, 184, 185

(56) References Cited

U.S. PATENT DOCUMENTS 6,205,918 B1 * 3/2001 Takahashi et al. ..... 101/118

6,345,573 B1 * 2/2002 Motoe et al. ..... 101/116

FOREIGN PATENT DOCUMENTS

JP 8-90893 * 4/1996
JP 2000-211231 * 8/2000

* cited by examiner

*Primary Examiner*—Leslie J. Evanisko
(74) *Attorney, Agent, or Firm*—Gary M. Nath; Harold L. Novick; Marvin C. Berkowitz

(57) ABSTRACT

A stencil printing machine and a method carrying out a printing operation are disclosed wherein a print sheet is transferred through between an upstream printing drum and a press roller in a pressured state to transfer ink onto an upper surface of the print sheet and is then transferred through between a downstream printing drum and a press roller in a pressured state to transfer ink onto the other surface of the print sheet to perform a both sides printing operation. A printing-drum drive escape mechanism is located to shift the downstream printing drum to a drive escape position to interrupt rotation of the printing drum while retaining the press roller in a separated position away from the shifted printing drum in such a manner that the printing operation under such a condition in a one side printing mode is executed.

8 Claims, 7 Drawing Sheets

STENCIL PRINTING MACHINE AND METHOD FOR PRINTING IN ONE-SIDED AND TWO-SIDED PRINTING MODES

BACKGROUND OF THE INVENTION

The present invention relates to a stencil printing machine and a method, and more particularly, to a stencil printing machine having two sets of printing sections in each of which a print medium is transferred through a path between a printing drum which carries thereon a stencil sheet and a pressure rotary member which is provided to the associated printing drum for thereby selectively carrying out a printing operation in a both sides printing mode and in a one side printing mode, and to a method of selectively carrying out a printing operation in a both sides printing mode and in a one side printing mode.

A stencil printing machine that enables a both sides printing operation with the use of two sets of printing sections is shown in FIG. 7. FIG. 7 shows an overall structure of the stencil printing machine for the both sides printing operation.

In FIG. 7, the stencil printing machine 100 is constructed of upstream and downstream stencil making sections 104, 105 with respective thermal printing heads 102, 103 for thermally perforating respective stencil sheets 101, 101 on the basis of respective image data, an upstream printing section 109 wherein the stencil sheet 101 made in the upstream stencil making section 104 is mounted onto an upstream printing drum 106 and a print sheet 107, which is fed thereto, is transferred through a path between the upstream printing drum 106 and a press roller 108 in a pressured contact relationship to transfer ink onto an upper surface (one surface) of the print sheet 107 during such a transfer step, a paper feed section 110 which feeds the print sheet 107 to the upstream printing section 109, an upstream belt-conveyer transfer unit 111 located at a sheet discharge side of the upstream printing section and transferring the print sheet 107 to a downstream side with the action of a belt 121, a downstream printing section wherein the stencil sheet 101, which is made in the downstream stencil making section 105, is mounted onto a downstream printing drum 112 and the print sheet, which is fed from the upstream belt conveyer transfer unit 111, is transferred through a path between the printing drum 112 and a press roller 114 in a pressured contact relationship to transfer ink onto a lower surface (the other surface) of the print sheet 107 during such a transfer step, and a downstream belt-conveyer transfer unit 117 with a belt 122 located at a sheet discharge side of the downstream printing section 115 for transferring the print sheet 107 to a sheet discharge tray 116 located in a downstream side.

Further, the upstream and downstream printing sections 109, 115 include squeegee rollers 123, 123 located inside the printing drums 106, 112, respectively, and held in contact with inner surfaces of outer peripheral walls 106*a*, 112*a* of the respective printing drums 106, 112, doctor rollers 124, 124 located in close proximity to the squeegee rollers 123, 123, respectively, to form respective given gaps relative thereto, and ink supply units 125, 125 each for supplying ink to an each area between the rollers 123, 124, with the squeegee rollers 123, 123 being arranged to rotate on inner peripheral surfaces of the outer peripheral walls 106*a*, 112*a* in association with rotations of the respective printing drums 106, 112. In addition, as the squeegee rollers 123, 123 rotate with, the rotations of the printing drums 106, 112, the outer peripheral surfaces of the squeegee rollers 123, 123 are adhered with ink in a given film thickness, with the adhered ink being.transferred to the outer peripheral walls 106*a*, 112*a* to allow ink to be supplied to an inner side of the print sheet 101 at all times.

Now, the both .sides printing operation is described below. Rotations of the printing drums 106, 112 allow the print sheet 107 to be fed from the paper feed section 110 to the upstream printing drum 106 in synchronism with the rotation thereof. The print sheet 107, thus fed to the printing drum 106, is brought into pressured contact with the stencil sheet 101 of the printing drum 106 with the press roller 108 to allow ink image to be transferred onto the upper surface of the print sheet 107, with the print sheet 107, whose upper surface is printed, being peeled off from the outer peripheral wall of the printing drum 106 and being introduced to the upstream conveyer-belt transfer unit 111. The upstream belt-conveyer transfer unit 111 causes the belt 121 to move for transferring the print sheet 107 with its lower surface remaining contact with the belt, thereby feeding the print sheet 107 from the most downstream side of the belt 121 to the downstream printing drum 112. The print sheet 107, thus fed to the downstream printing drum 106, is then brought into pressured contact with the stencil sheet 101 of the printing drum 112 with the press roller 114 to transfer ink image onto the lower surface of the print sheet 107, with the print sheet 107, whose lower surface is printed, being peeled off from the outer peripheral wall of the printing drum 112 to be introduced to the downstream belt-conveyer transfer unit 117. The downstream belt-conveyer transfer unit 117 causes the belt 122 to move for transferring the print sheet 107 from the most downstream side of the belt 122 to the sheet discharge tray 116. The print sheet 107 thus discharged to the sheet discharge tray 116 is placed therein in the stacked state.

Also, such a stencil printing machine is disclosed in Japanese Patent Application Laid-Open Publication No. 8-90893.

In the aforementioned stencil printing machine for the both sides printing operation, it is desired to achieve a one side printing operation and, so, various attempts have been conducted in the related art. For example, one technology to achieve this end concerns the two printing drums 106, 112, one of which is mounted with a stencil sheet 101 which is perforated on the basis of image data, and the other one of which is mounted with a non-perforated stencil sheet 101. With such arrangement, when executing the printing operation in the same manner as the both sides printing operation, the print sheet is transferred with ink at the printing section mounted with the perforated stencil sheet 101 whereas the print sheet is not transferred with ink at another printing section mounted with the non-perforated stencil sheet 101, thereby achieving the one side printing operation.

An alternative approach to achieve the one side printing operation is to locate a transfer unit at the discharge side of the upstream printing section 109 to transfer the print sheet 107 in another route to the sheet discharge tray without directing the print sheet 107 to the downstream printing section 115. With such a structure, during the one side printing mode, the print sheet 107, which is printed in the upstream printing section 109, is discharged in another route, thereby achieving the one side printing operation.

SUMMARY OF THE INVENTION

However, in the former one side printing technology, the presence of the need for mounting the non-perforated stencil sheet onto one of the printing drums induces the waste of the stencil sheets. In the latter one side printing technology, the presence of the need for additionally locating the transfer unit as an extra printing drum mechanism in another route specific for the one side printing operation is a major cause of an inherent large size in structure and an increase in manufacturing cost.

Since, further, the two printing drums 106, 112 must be rotated in synchronism with one another while retaining a given rotational angular phase difference, it is a usual practice to employ a single drive source for rotating both of these printing drums. Accordingly, if the printing drum 106 (or 112), which is not in charge of the one side printing operation, is rotated, this rotation of the printing drum causes the squeegee roller 123 remaining inside the printing drum to rotate, with a resultant undesired continuous operation of the squeegee roller 123 to supply ink to the outer peripheral wall 106*a* (or 112*a*) of the printing drum 106 (or 112). Since, however, this ink is not transferred to the print sheet 107 and is merely subjected to an undesired kneaded result, another problem is encountered in that an excessive amount of kneading frequencies of ink results in deterioration of quality.

The present invention has been made in view of the above studies and has an object to provide a stencil printing machine and a method for performing a printing operation which enable a one side printing operation without causing the waste of stencil sheets, without providing a transfer mechanism in another route for the one side printing operation and also without causing deterioration in the quality of ink.

According to one aspect of the present invention, there is provided a stencil printing machine selectively carrying out a printing operation in a both sides printing mode and in a one side printing mode, which comprises: an upstream printing section including a first printing drum formed with an ink permeable outer peripheral wall adapted to be mounted with a stencil sheet, a first ink supply unit supplying ink to an inner periphery of the first printing drum, and a first press rotary member operative to be held in a pressured position in contact with the outer peripheral wall of the first printing drum to allow ink to be transferred onto one surface of a print medium; a downstream printing section including a second printing drum formed with an ink permeable outer peripheral wall adapted to be mounted with a stencil sheet, a second ink supply unit supplying ink to an inner periphery of the second printing drum, and a second press rotary member operative to be held in a pressured position in contact with the outer peripheral wall of the second printing drum to allow ink to be transferred onto the other surface of the print medium; a paper feed section feeding the print medium to the upstream printing section; and a printing-drum drive escape mechanism operative to shift either selected one of the first and second printing drums into a drive escape position to interrupt rotation of the selected printing drum while retaining either selected one, associated with the selected printing drum, of the first and second press rotary members in a separated position to pass the print medium into a sheet discharge section along the selected printing drum without contact with the selected press rotary member, in the one side printing mode.

Besides according to the present invention, a method, which selectively carries out a printing operation in a both sides printing mode and in a one side printing mode, provides an upstream printing section including a first printing drum and a first press rotary member operative to shift between a pressured position and a separated position relative to the first printing drum; provides a downstream printing section including a second printing drum and a second press rotary member operative to shift between a pressured position and a separated position relative to the second printing drum; provides a printing-drum drive escape mechanism operative to enable a shift of either selected one of the first and second printing drums into a drive escape position; feeds a print medium to the upstream printing section; and feeds the print medium, which is discharged from the first printing drum of the upstream printing section, to the downstream printing section. Here, when the one side printing mode is selected, the printing-drum drive escape mechanism is operative to shift either selected one of the first and second printing drums to a drive escape position to render the selected printing drum inoperative and to render the selected press rotary member to remain in a separated position away from the selected printing drum to pass the print medium into a sheet discharge section along the selected printing drum without contact with the selected press rotary member, in the one side printing mode.

Other and further features, advantages, and benefits of the present invention will become more apparent from the following description taken in conjunction with the following drawings.

BRIEF DESCRIPTION OF THE DRAWINGS

FIGS. 2A and 2B show a downstream printing-drum drive escape mechanism according to the embodiment of the present invention, wherein FIG. 2A is a plan view of the downstream printing-drum drive escape mechanism where the printing drum remains in an operative, drive position and FIG. 2B is a plan view of the downstream printing-drum drive escape mechanism where the printing drum remains in an inoperative, drive escape position;

DETAILED DESCRIPTION OF THE PREFERRED EMBODIMENT

To describe the present invention more in detail, an embodiment of a digital type stencil printing machine and a method for the stencil printing machine according to the present invention will be described below in detail with reference to the drawings.

(Structural Overview of Stencil Printing Machine)

Figure 1:
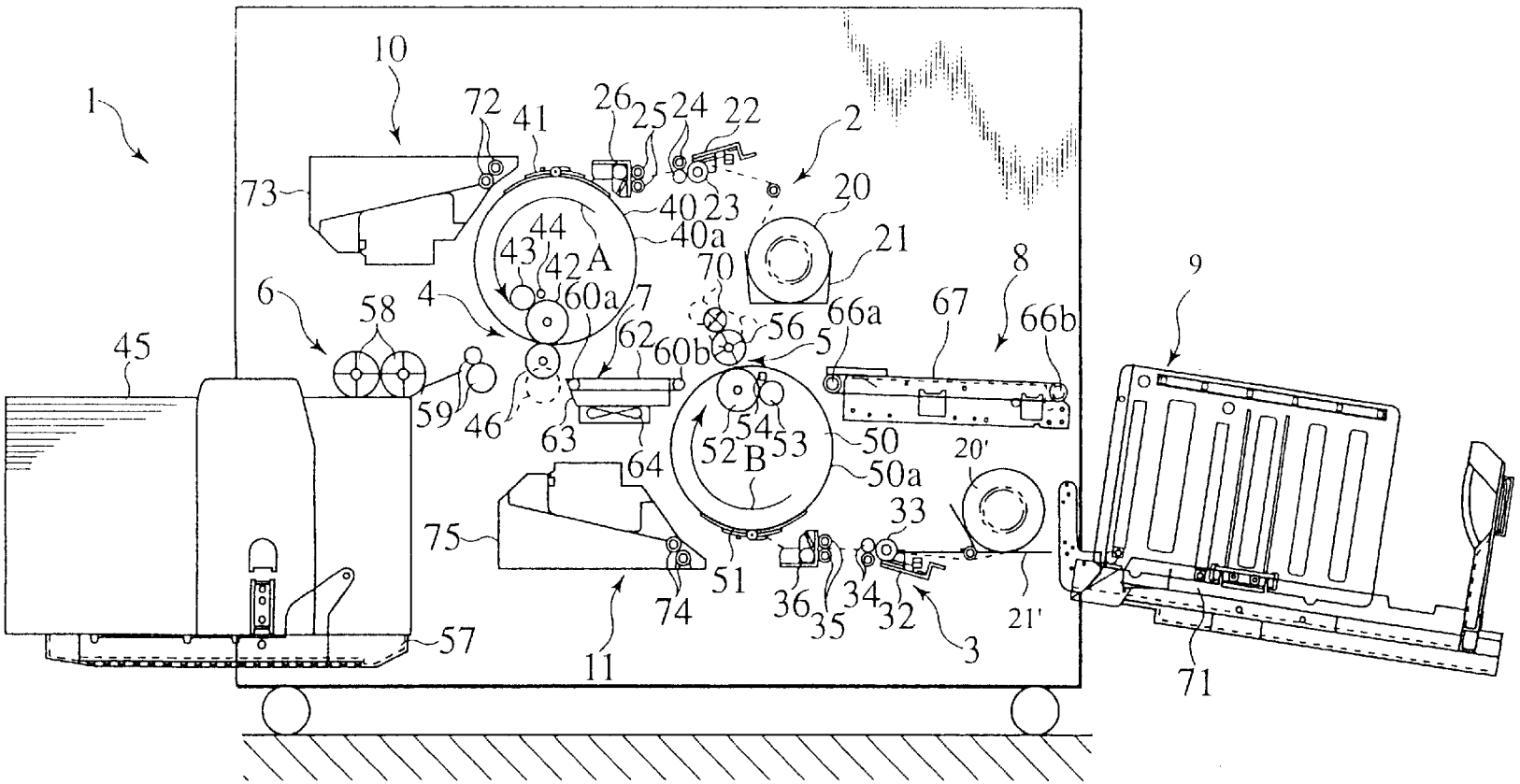
FIG. 1 is a schematic structural view of a stencil printing machine according to an embodiment of the present invention.
Figure 2B:
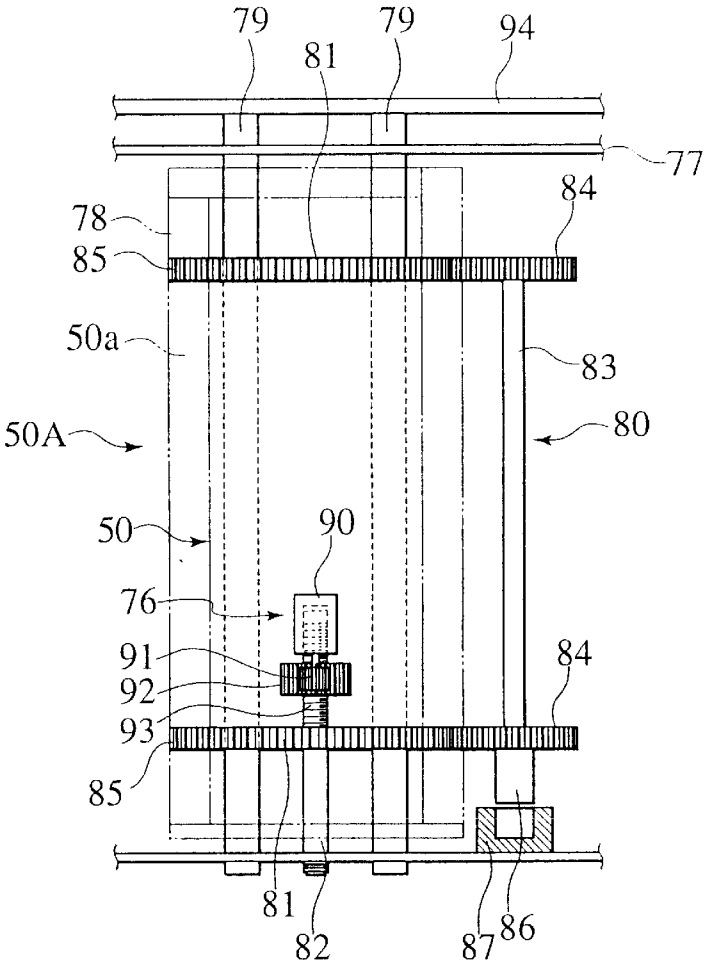
Figure 2A:
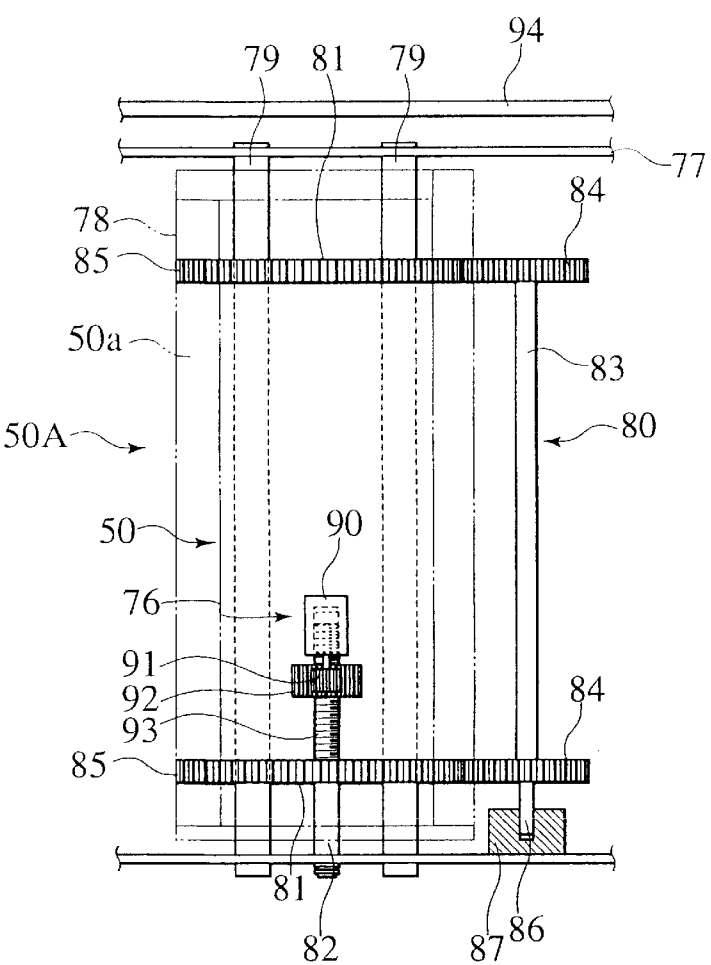
Figure 3:
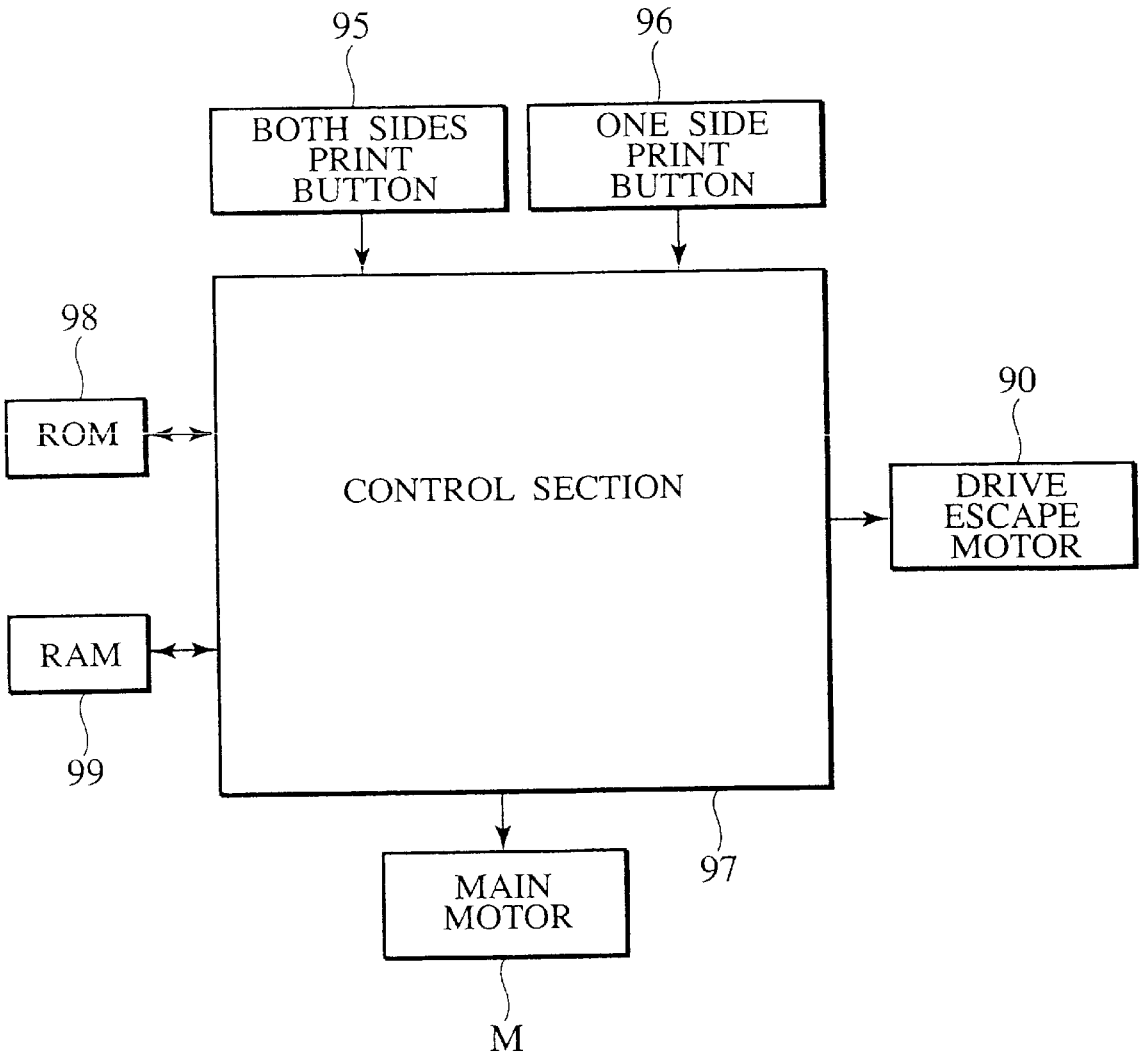
FIG. 3 is a block diagram for illustrating a control circuitry to perform a drive escape operation for the relevant printing drum of the stencil printing machine according to the embodiment of the present invention.
Figure 4:
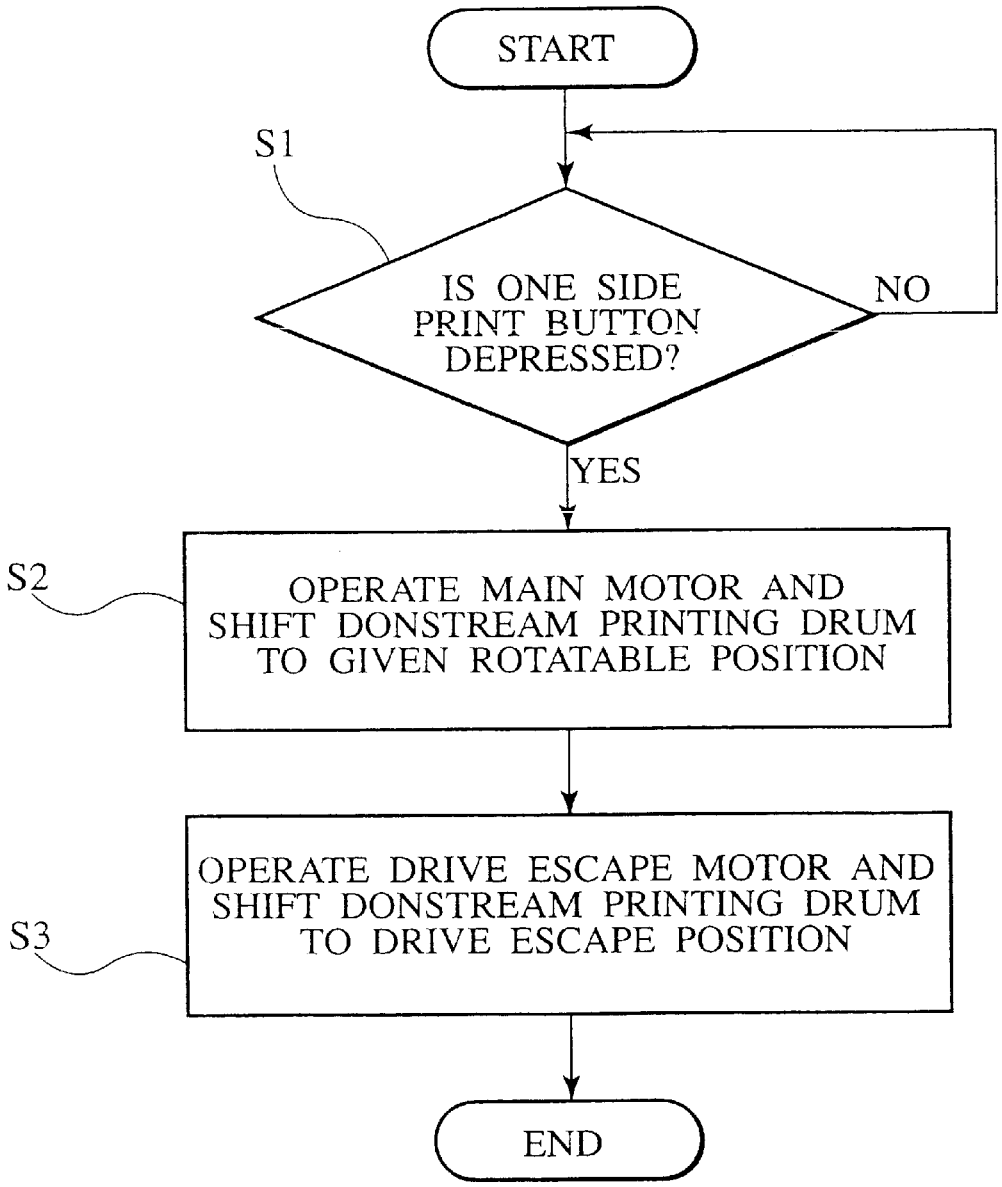
FIG. 4 is a general flow diagram for illustrating the basic sequence of the drive escape operation to be carried out when a one side printing mode is selected to perform a method according to the embodiment of the present invention.
Figure 5:
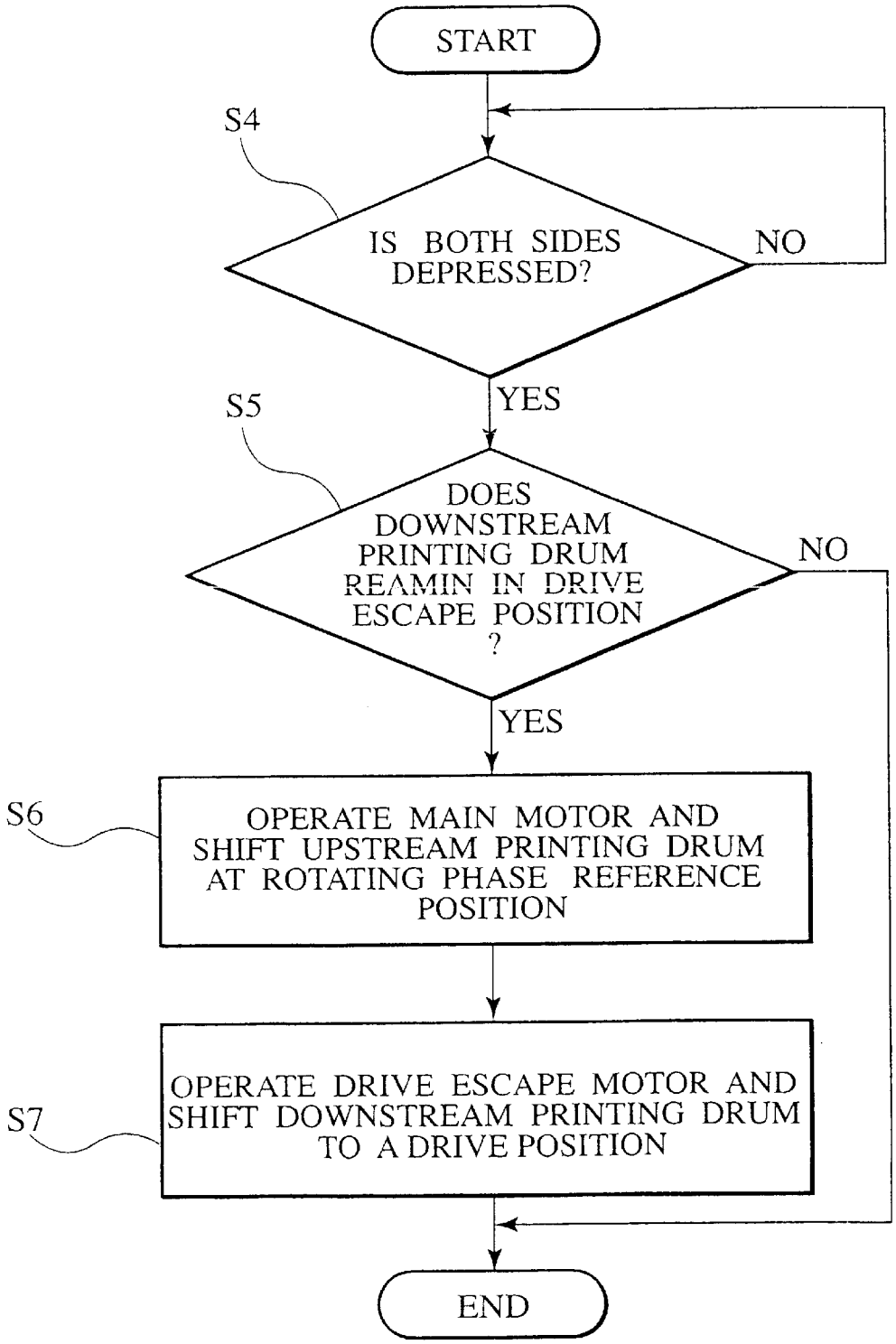
FIG. 5 is a general flow diagram for illustrating the basic sequence of operation for restoring the relevant printing drum from the drive escape condition to be carried out when a both sides printing mode is selected to perform the method according to the embodiment of the present invention.
Figure 6:
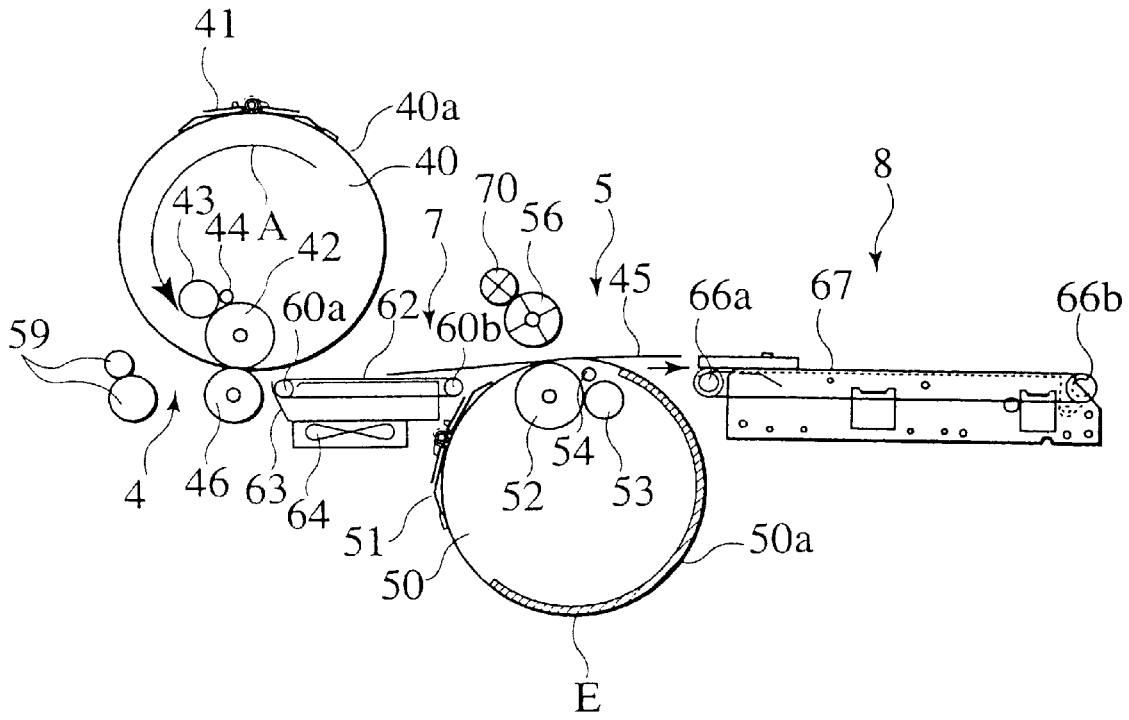
FIG. 6 is a summary structural view for illustrating operative conditions of the upstream printing section and the downstream printing section during the one side printing mode according to the embodiment of the present invention.
Figure 7:
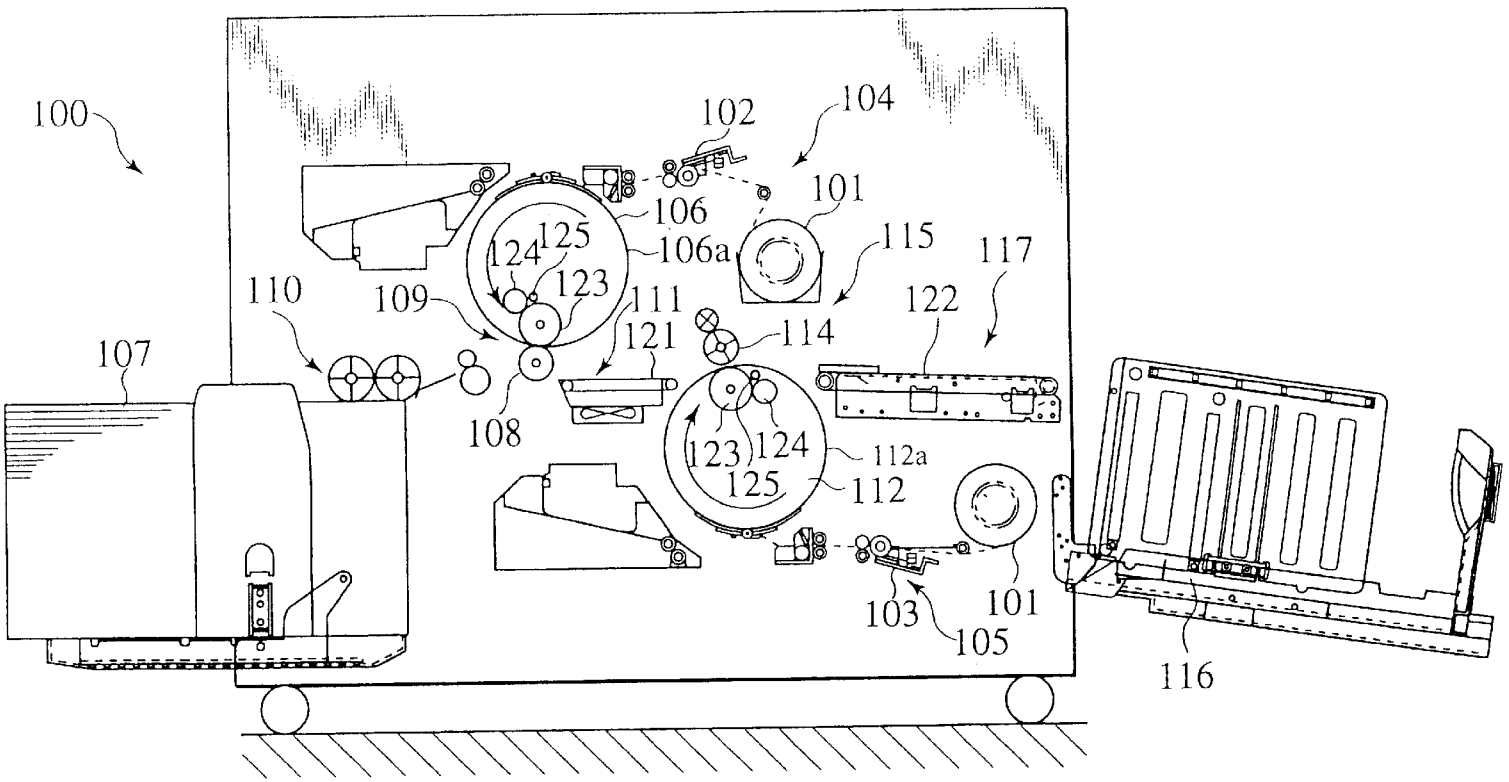
FIG.7 (PRIOR ART)
FIG. 7 is an overall structural view of a stencil printing machine studied by the present inventor.

FIGS. 1 to 6 show a stencil printing machine of a typical embodiment of the present invention to carry out a method of the present invention, wherein FIG. 1 shows a schematic overall structural view of the stencil printing machine, FIG. 2A is a plan view of a downstream printing-drum drive escape mechanism by which the relevant printing drum remains in an operative, drive-connection state, FIG. 2B is a plan view of the downstream printing-drum drive escape mechanism by which the relevant printing drum remains in an inoperative, drive escape position, FIG. 3 is a block diagram of a control circuitry to perform a drive escaping operation for the relevant printing drum, FIG. 4 is a flow diagram of the drive escape operation to be performed when a one side printing mode is selected, FIG. 5 is a flow diagram of the drive escaping operation to be performed when a both sides printing operation mode is selected, and FIG. 6 is a summary structural view for illustrating operative conditions of an upstream printing section and a downstream printing section in the one side printing mode.

Referring to FIG. 1, the digital type stencil printing machine 1 is mainly constructed of an original read out section (not shown), an upstream stencil making section 2, a downstream stencil making section 3, an upstream printing section 4, a downstream printing section 5, a paper feed section 6, an upstream belt transfer unit 7, a downstream belt transfer unit 8, a sheet discharge section 9, an upstream stencil disposal section 10 and a downstream stencil disposal section 11.

Original Readout Section

The original read out section (not shown) includes, for example, an automatic paper feed and read out unit for obtaining image data by automatically feeding an original, and an original positioning and read out unit for obtaining image data from the original which is positioned in place. The automatic paper feed and read out unit is constructed of an inclined original resting plate to allow the original to be rested, an original feed roller pair for transferring the original resting on the inclined original resting plate, and a line image sensor for obtaining image data by converting contents of the original, which is transferred, to a train of electric signals. The line image sensor is commonly used as that of the original positioning and read out unit.

The original positioning and read out unit includes a horizontal original positioning glass table for allowing the original to be positioned, a pressure plate located on the horizontal original positioning glass table for free opening and closing capabilities, a guide belt located in an area below the horizontal original positioning glass plate to be moveable with a drive force of a pulse motor, and the line image sensor which is guided with the guide belt to move in the area below the original positioning glass plate.

Further, the line image sensor of the automatic paper feed and read out unit has the line image sensor reads out the original, which is transferred with the original feed roller pair, with the line image sensor. In the original positioning and read out unit, the line image sensor is guided and moved with the guide belt to scan a lower surface of the original to read out the contents of the original.

Upstream Stencil Making Section

The upstream stencil making section 2 includes a stencil sheet receiving tray 21 which receives an elongated stencil sheet 20 in the form of a roll, a thermal printing head 22 composed of a writing head which is located at a position downstream of the stencil sheet receiving tray 21 in a transfer direction of the stencil sheet 20 relative to the stencil sheet receiving tray 21, a platen roller 23 located in opposed relation to the thermal printing head 22 and driven by a pulse motor (not shown), a stencil feed roller pair 24 located downstream of the thermal printing head 22 and the platen roller 23 in the transfer direction of the stencil sheet 20 and rotated with the drive force of the pulse motor (not shown), a stencil feed roller pair 25 located further downstream of the stencil feed roller pair 24 in the transfer direction of the stencil sheet, and a stencil cutter 26 located downstream of the stencil feed roller pair 25. The thermal printing head 22 includes a plurality of dot-shaped thermal elements located, in a plane perpendicular to the transfer direction of the stencil sheet 20, to occupy a space in a range equal to a paper size of A3 to meet the maximum size A3 of a print sheet which is intended in the present embodiment.

In addition, rotation of the platen roller 23 and the stencil feed roller pair 24 allows the stencil sheet 20 to be transferred. During such transfer of the stencil sheet 20, the dot-shaped thermal elements of the thermal printing head 22 are selectively activated to produce heat on the basis of image data, which corresponds to an upper surface (one surface) of the original, read out with the line image sensor to permit thermal perforation in the stencil sheet 20 to form a desired perforated area, with a trailing edge of the stencil sheet 20, which has the desired perforated area, being cut with the stencil cutter 36 to form a perforated stencil sheet 20 of a given length.

Downstream Stencil Making Section

The downstream stencil making section 3 includes a stencil sheet receiving tray 21' which receives an elongated stencil sheet 20' in the form of a roll, a thermal printing head 32 composed of a writing head which is located at a position downstream of the stencil sheet receiving tray 21' in a transfer direction of the stencil sheet 20' relative to the stencil sheet receiving tray 21', a platen roller 33 located in opposed relation to the thermal printing head 32 and driven by a pulse motor (not shown), a stencil feed roller pair 34 located downstream of the thermal printing head 32 and the platen roller 33 in the transfer direction of the stencil sheet 20' and rotated with the drive force of the pulse motor (not shown), a stencil feed roller pair 35 located further downstream of the stencil feed roller pair 34 in the transfer direction of the stencil sheet, and a stencil cutter 36 located downstream of the stencil feed roller pair 35. The thermal printing head 32 includes a plurality of dot-shaped thermal elements located, in a plane perpendicular to the transfer direction of the stencil sheet 20', to occupy a space in a range equal to a paper size of A3 to meet the maximum size A3 of a print sheet which is intended in the present embodiment.

In addition, rotation of the platen roller 33 and the stencil feed roller pair 34 allows the stencil sheet 20' to be transferred. During such transfer of the stencil sheet 20', the dot-shaped thermal elements of the thermal printing head 32 are selectively activated to produce heat on the basis of image data, which corresponds to a lower surface (the other surface) of the original, read out with the line image sensor to permit thermal perforation in the stencil sheet 20' to form a desired perforated area, with a trailing edge of the stencil sheet 20', which has the desired perforated area, being cut with the stencil cutter 36 to form a perforated stencil sheet 20' of a given length.

Upstream Printing Section

The upstream printing section 4 is constructed of an upstream printing drum 40 that includes an outer peripheral wall 40*a* composed of an ink permeable member formed in a perforated structure and that rotates in a direction as shown by an arrow A in FIG. 1 with a drive force of a main motor M (see FIG. 3), and a stencil clamping segment 41 mounted to the outer periphery 40*a* of the printing drum 40 for clamping a leading edge of the stencil sheet 20.

Further, the upstream printing section 4 includes a squeegee roller 42 located inside the outer peripheral wall 40*a* and held in contact with an inner peripheral surface of the outer peripheral wall 40*a*, a doctor roller 43 spaced from the squeeze roller 42 with a given gap, an ink supply unit 44 for supplying ink to an area between the rollers 42, 43, a press roller 46 which is located in an area outside the printing drum 40 in opposed relation to the squeeze roller 42 via the outer peripheral wall 40*a* thereof and which serves as a rotating press member, and a pressure exerting unit (not shown) which selectively moves the press roller 46 into a pressured engagement position, (a position as indicated by a solid line in FIG. 1) to urge the press roller 46 against the outer peripheral wall 40*a* of the printing drum 40, and a separated position (a position indicated by a phantom line in FIG. 1) to separate the press roller 46 from the outer peripheral wall 40*a* of the printing drum 40. The press roller 46 functions to move between the pressured engagement position and the separated position in association with rotation of the printing drum 40 during the printing operation such that, during transit of the print sheet 45, which serves as a print medium, transferred in synchronism with rotation of the printing drum 40, the press roller 46 remains in the pressured engagement position and, during other operating phase (i.e., during non-transit of the print sheet 45), the press roller 46 remains in the separated position.

With such a structure, clamping the leading edge of the stencil sheet 20, which is transferred from the upstream stencil making section 2, with the stencil clamping segment 41, while permitting rotation of the printing drum 40 under the clamped state of the stencil sheet 20 allows the stencil sheet 20 to be wound around and mounted to the outer periphery 40*a* of the printing drum 40. When this occurs, the print sheet 45, which is transferred in synchronism with the rotation of the printing drum 40, is brought into pressured contact with the stencil sheet 20 of the printing drum 40 with the action of the press roller 46, allowing ink to be transferred through the perforated area of the stencil sheet 20 onto the upper surface (the one surface) of the print sheet 45 to reproduce a desired image thereon.

Downstream Printing Section

The downstream printing section 5 is constructed of a downstream printing drum 50 that includes an outer peripheral wall 50*a* composed of an ink permeable member formed in a perforated structure and that rotates in a direction as shown by an arrow B in FIG. 1 with a drive force of a main motor M (see FIG. 3), and a stencil clamping segment 51 mounted to the outer periphery 50*a* of the printing drum 50 for clamping a leading edge of the stencil sheet 20'. The downstream printing drum 50 is able to shift to a drive escape position to interrupt a drive connection between the main motor M and the downstream printing drum 50 by means of a printing-drum drive escape mechanism 76.

Further, the downstream printing section 5 includes a squeegee roller 52 located inside the outer peripheral wall 50*a* and held in contact with an inner peripheral surface of the outer peripheral wall 50*a*, a doctor roller 53 spaced from the squeeze roller 52 with a given gap, an ink supply unit 54 for supplying ink to an area between the rollers 52, 53, a press roller 56 which is located in an area outside the printing drum 50 in opposed relation to the squeeze roller 52 via the outer peripheral wall 50*a* thereof and which serves as a rotating press member, a pressure exerting unit (not shown) which selectively moves the press roller 56 into a separated position (a position as indicated by a solid line in FIG. 1) to urge the press rolled 56 against the outer peripheral wall 50*a* of the printing drum 50 and a pressured position (a position indicated by a phantom line in FIG. 1) to separate the press roller 56 from the outer peripheral wall 50*a* of the printing drum 50, and a cleaning roller 70 which is selectively brought into contact with the press roller 56 to avoid ink from being adhered to the press roller 56 or to remove adhered ink from the press roller 56. The press roller 56 functions to move between the pressured engagement position and the separated position in association with rotation of the printing drum 50 during the printing operation such that, during transit of the print sheet 45, which serves as a print medium, transferred in synchronism with rotation of the printing drum 50, the press roller 56 remains in the pressured engagement position and, during other operating phase (i.e., during non-transit of the print sheet 45), the press rollers 56 remains in the separated position.

With such a structure, clamping the leading edge of the stencil sheet 20', which is transferred from the upstream stencil making section 2, with the clamping base 51, while permitting rotation of the printing drum 50 under the clamped state of the stencil sheet 20' allows the stencil sheet 20' to be wound around and mounted to the outer periphery 50*a* of the printing drum 50. When this occurs, the print sheet 45, which is transferred in synchronism with the rotation of the printing drum 50, is brought into pressured contact with the stencil sheet 20' of the printing drum 50 with the action of the press roller 56, allowing ink to be transferred through the perforated area of the stencil sheet 20' onto the lower surface (the other one surface) of the print sheet 45 to reproduce a desired image thereon.

Paper Feed Section

The paper feed section 6 is constructed of a paper feed tray 57 on which a stack of the print sheets 45, which serve as printing media, is placed, a primary paper feed roller pair 58 for moving only one print sheet 45 from the uppermost position of the stack of the print sheets 45 in the paper feed tray 57, and a secondary paper feed roller pair 59 for transferring the print sheet 45, which is transferred with the paper feed roller pair 58, to an area between the printing drum 40 and the press roller 46 in synchronism with the rotation of the upstream printing drum 40. The primary and secondary paper feed roller pairs 58, 59 are so arranged as to be selectively applied with the drive force of the main motor M by means of respective paper feed clutches (not shown).

Upstream Belt-Conveyer Transfer Unit

The upstream belt-conveyer transfer unit (the upstream transfer unit) 7 function to receive the print sheet 45 discharged from the upstream printing section 4 to transfer the received print sheet 45 to an area in front of the downstream printing section 5 to be fed thereto. The upstream belt-conveyer transfer unit 7 includes a pair of belt stretching members 60*a*, 60*b*, a belt 62 stretched between the pair of belt stretching members 60*a*, 60*b*, an intake box 63 and an intake fan 64 for sucking the leading edge of the print sheet 45 transferred on the belt 62, and a belt drive unit (not shown) to drive the belt 62 for rotating movement of the belt stretching member 60*a* (or 60*b*). Further, the upstream belt-conveyer transfer unit 7 functions to suck the print sheet 45 to transfer the print sheet 45 due to the movement of the belt 62 per se under a condition that the surface of the print sheet 45 opposed to the previously printed surface is held in contact with the belt 62.

Downstream Belt-Conveyer Transfer Unit

The downstream belt-CONVEYER transfer unit (the upstream transfer unit) 8 function to receive the print sheet 45 discharged from the downstream printing section 5 to transfer the received print sheet 45 to the sheet discharge section 9. The downstream belt-conveyer transfer unit 8 includes a pair of pulleys 66*a*, 66*b*, a belt 67 stretched between the pair of pulleys 60*a*, 60*b*, an intake box (not shown) and an intake fan (not shown) for sucking the leading edge of the print sheet 45 transferred on the belt 67, and a belt drive unit (not shown) to drive the belt 67 for rotating movement of the pulley 66*a* (or 66*b*). Further, the downstream belt-conveyer transfer unit 8 functions to suck the print sheet 45 to transfer the print sheet 45 due to the movement of the belt 67 per se.

Sheet Discharge Section

The sheet discharge section 9 includes a paper receiving tray 71 located in a drop area of the print sheet 45 for allowing the print sheet 45, which has been printed and is transferred with the downstream belt-conveyer transfer mechanism 8, to be placed in a stacked state.

Upstream Stencil Disposal Section

The upstream stencil disposal section 10 includes a stencil separating roller pair 72 for receiving the leading edge of the stencil sheet 20, which has been previously wound on the upstream printing drum 40 with the leading edge being released from the upstream printing drum 40, and for transferring the stencil sheet 20, whose clamped state is released, while peeling off the same from the upstream printing drum 40, and a stencil disposal box 73 for receiving the stencil sheet 20 which is transferred with the stencil separating roller pair 72.

Downstream Stencil Disposal Section

The downstream stencil disposal section 11 includes a stencil separating roller pair 74 for receiving the leading edge of the stencil sheet 20', which has been previously wound on the downstream printing drum 50 with the leading edge being released from the downstream printing drum 50, and for transferring the stencil sheet 20', whose clamped state is released, while peeling off the same from the downstream printing drum 50, and a stencil disposal box 75 for receiving the stencil sheet 20' which is transferred with the stencil separating roller pair 74.

Printing Drum Unit

Though the aforementioned printing-drum drive escape mechanism 76 is described below in detail, since the printing drum 50 is constructed as a printing drum unit 50A, a detailed description will begin first from the structure of the printing drum unit 50A for the purpose for convenience of description. As shown in FIGS. 2A and 2B, the printing drum unit 50A is arranged to be inserted to and to be retracted from a printing drum opening (not shown) of a body frame 77 by means of a printing drum guide rail member (not shown). Further, the printing drum unit 50A includes a printing drum frame body 78, a pair of slide support shafts 79, 79, the printing drum 50 whose stationary side is fixed to the slide support shafts 79, 79, and a drum-rotation power-delivery unit 80 that delivers rotational power to the printing drum 50.

The printing drum 50 is constructed having a pair of left and right disks (not shown) that are supported on and fixedly secured to the slide support shafts 79, 79 in a spaced relationship, a pair of annular frames 81, 81 rotatably supported on the left and right disks, respectively, a stencil clamping base (not shown) which has the stencil clamping segment 51 interconnected at their ends to the annular frames 81, 81, respectively, and the screen stretched to cover substantially whole parts of the respective annular frames 81, 81 in association with the stencil clamping base, with the screen serving as the outer peripheral wall 50*a*. Further, the stationary side of the printing drum 50 is connected to and supports a center shaft 82 with a rotational axis around which the printing drum 50 is rotated while, when the printing drum 50 is mounted to the body frame, the center shaft 82 serves as a center to be mounted.

The drum-rotation power-delivery unit 80 is constructed of a shaft 83 rotatably supported by the stationary side of the printing drum 50, two gears 84, 84 connected to end portions of the shaft 83, a pair of flange gear units 85, 85 formed on respective outer peripheries of the left and right annular frames 81, 81, and a drum-side input drive coupling section 86 fixed to a distal end of the shaft 83. A frame-side output drive coupling section 87 is connected to the body frame 77 at a position opposing to the drum-side input drive coupling section 86 such that the frame-side output drive coupling section 87 is applied with drive power from the aforementioned main motor M.

Printing-Drum Drive Escape Mechanism

The printing-drum drive escape mechanism 76 includes a drive escape motor 90 fixedly secured to the stationary side of the printing drum 50, a gear 91 fixed to a rotational axis of the drive escape motor 90, a cylindrical gear 92 meshing with the gear 91 and rotatably supported on the stationary side of the printing drum 50, and a threaded rod segment 93 meshing with an internal gear segment of the cylindrical gear 92 and integrally formed on the center shaft 82. Further, when the drive escape motor 90 is rotated, the cylindrical gear 92 rotates to deliver rotational power to the threaded rod segment 93, the printing drum 50, which is slidable with respect to the printing drum frame body 78, is moved in an axial direction because the leading edge of the center shaft 82 is supported with the body frame 77.

With such movement, the drum-side input drive coupling section 86 is connected to the frame-side output drive coupling section 87 to assume a mounting position to allow drive power from the main motor M to be delivered to the printing drum 50 to be rotatable as seen in FIG. 2A, and drive connection between the drum-side input drive coupling section 86 and the frame-side output drive coupling section 87 is released to assume a drive escape position to interrupt the drive connection between the main motor M and the printing drum 50 as seen in FIG. 2B.

In FIGS. 2A and 2B, also, reference numeral 94 designates a front door which is mounted to a front area of the body frame 77 and which is opened to allow the printing drum unit 50A to be mounted to or to be removed from the body frame 77. In an opened phase of the front door 94, the main motor M is turned off for the security.

Control System Executing Drive Escape Operation

Now, the control system for executing the basic sequence in operational steps of the drive escape operation is described below in detail. As seen in FIG. 3, an operation panel of the frame body 77 has a both sides print button 95 and a one side print button 96, both of which produce output signals to be applied to a control section 97. Further, the control section 97 is supplied with respective rotating angular positional information of the upstream and downstream printing drums 40, 50. The control section 97 controls write-in or read-out of ROM 98, that stores various program items, and RAM 99 such that, when the print buttons 95, 96 are operated, the control section 97 executes a flow chart of a sequence of operational steps shown in FIGS. 4 and 5. The content of such control is described below in detail with respect to the various operational steps.

(Both Sides Printing Operation)

Now, the stencil making operation and the both sides printing operation of the aforementioned stencil printing machine 1 during a both sides printing mode is described. When selecting the both sides printing mode, the control section 97 checks whether the stencil sheets 20, 20' are mounted to the printing drums 40, 50 such that, when the stencil sheets 20, 20' are mounted to the printing drums 40, 50, the stencil sheets 20, 20' are removed from the respective printing drums 40, 50 and are disposed into the stencil disposal boxes 73, 75.

When terminating the stencil disposal operation, the stencil sheet 20 is thermally perforated with the thermal printing head 22 on the basis of image data of the upper face of the original that is read out in the original read-out operation. Next, the perforated stencil sheet 20 is wound on and mounted to the upstream printing drum 40 to execute a stencil sheet mounting process, thereby completing a stencil sheet mounting operation for the upstream printing drum. Likewise, the stencil sheet 20' is thermally perforated with the thermal printing head 32 on the basis of image data of the lower face of the original that is read out in the original read-out operation. Next, the perforated stencil sheet 20' is wound on and mounted to the downstream printing drum 50 to execute a stencil sheet mounting process, thereby completing a stencil sheet mounting operation for the downstream printing drum.

Next, when selecting the both-face printing operation by pressing the both-face print button 95, the control section 97 checks whether the print sheet 45 is placed in the paper feed tray 57 and, in a case where there is no print sheet 45, the control section 97 implements an error operation. Also, the control section 97 checks whether the stencil sheets 20, 20' are mounted to the printing drums 40, 50, respectively, and, in a case where there are no stencil sheets 20, 20' mounted on the respecting printing drums 40, 50, the control section 97 executes a non-stencil error operation. Further, the control section 97 checks whether ink remains in ink pools between the squeegee roller 42 and the doctor roller 43 and between the squeegee roller 52 and the doctor roller 53 and, when no ink is found in the ink pools, the control section 97 executes a non-ink error operation. Also, although the control section 97 checks whether the downstream printing drum 50 remains in the drive-connection escaping position, such an operation is described below in detail and, here, the downstream printing drum 50 is described as being positioned in the mounting position.

When clearing all checking items, the main motor M is operated to rotate the respective printing drums 40, 50, allowing the print sheet 45 to be fed to the upstream printing drum 40 from the paper feed section 6 in synchronism with rotation of the main motor M. The print sheet 45 is urged against the stencil sheet 20 of the printing drum 40 with the press roller 46, thereby allowing ink to be transferred onto the upper face of the print sheet 45 to reproduce an ink image thereon. The print sheet 45, whose upper face is printed, is peeled off from the outer periphery of the printing drum 40 and is conducted to the upstream belt-conveyer transfer unit 7. The upstream belt-conveyer transfer unit 7 allows the belt 62 to move for transferring the print sheet 45, whose lower surface is held in contact with the belt 62, such that the print sheet 45 is fed to the downstream printing drum 50 from the most downstream side of the belt 62. Thus, the print sheet 45 is urged against the stencil sheet 20' of the printing drum 50 with the press roller 56 to allow the lower surface of the print sheet 45 to be transferred with ink image. The print sheet 45, whose lower face is printed, is peeled off from the outer periphery of the printing drum 50 and is conducted to the downstream belt-conveyer transfer unit 8. The downstream belt-conveyer transfer unit 8 allows the belt 67 to move for transferring the print sheet 45 from the most downstream side of the belt 67 to the sheet discharge tray 71. The print sheet 45 thus discharged to the sheet discharge tray 71 is placed in the stacked condition.

(One Side Printing Operation)

Now, the stencil making operation and the one side printing operation of the aforementioned stencil printing machine 1 during a one side printing mode is described. When the one side printing mode is selected, the control section 97 checks whether the stencil sheets 20, 20' are mounted to the printing drums 40, 50 such that, when the stencil sheet 20 is mounted to the printing drum 40, the stencil sheet 20 is removed from the upstream printing drum 40 and is disposed into the stencil disposal box 73. The stencil sheet 20' of the downstream printing drum 50 is not disposed and remains in the mounted position.

When terminating the stencil disposal operation, the stencil sheet 20 is thermally perforated with the thermal printing head 22 on the basis of image data of the upper face of the original that is read out in the original read-out operation. Next, the perforated stencil sheet 20 is wound on and mounted to the upstream printing drum 40 to execute the stencil sheet mounting process, thereby completing the stencil sheet mounting operation for the upstream printing drum.

Next, as shown in FIG. 4, when the one side printing operation is selected by pressing the one side print button 96 (step S1), the control section 97 drives the main motor M to allow the downstream printing drum 50 to be moved to a rotational angular position (i.e., a position shown in FIG. 6, wherein a hatched area E designated a perforated area of the stencil sheet 20') wherein the print sheet 45 is held in contact with the downstream printing drum 50 at a position except the perforated area of the stencil sheet 20' and except the stencil clamping segment 51 (in step S2). Then, the drive escape motor 90 is driven to shift the downstream printing drum 50 to the drive escape position shown in FIG. 2B (in step S3).

Further, the control section 97 checks whether the print sheet 45 is placed in the paper feed tray 57 and, in a case where there is no print sheet 45, the control section 97 implements a non-paper error operation. Further, the control section 97 checks whether ink remains in ink pools between the squeegee roller 42 and the doctor roller 43 and between the squeegee roller 52 and the doctor roller 53 and, when no ink is found in the ink pools, the control section 97 executes the non-ink error operation.

When clearing all the checking items, the main motor M is operated to rotate only the printing drum 40, allowing the print sheet 45 to be fed to the upstream printing drum 40 from the paper feed section 6 in synchronism with rotation of the main motor M. The print sheet 45 is urged against the stencil sheet 20 of the printing drum 40 with the press roller 46, thereby allowing ink to be transferred onto the upper face of the print sheet 45 to reproduce an ink image thereon. The print sheet 45, whose upper face is printed, is peeled off from the outer periphery of the printing drum 40 and is conducted to the upstream belt-conveyer transfer unit 7. The upstream belt-conveyer transfer unit 7 allows the belt 62 to move for transferring the print sheet 45, whose lower surface is held in contact with the belt 62, such that the print sheet 45 is fed to the downstream printing drum 50 from the most downstream side of the belt 62.

The print sheet 45 thus fed passes through between the outer periphery 50*a* of the printing drum 50, which remains in the halted condition, and the press roller 56 which remains in the separated position, to be conducted to the downstream belt-conveyer transfer mechanism 8.

That is, as shown in FIG. 6, since the downstream printing drum 50 remains in the drive escape position, the printing drum 50 is not delivered with rotational power of the main motor M to remain in the stationary condition, while the press roller 56, which is shifted in association with rotation of the printing drum 50, remaining in the separated position. Upon receiving the print sheet 45, which has passed through the space between the printing drum 50 and the press roller 56, the downstream belt-conveyer transfer unit 8 allows the belt 67 to move for transferring the print sheet 45 to be discharged into the sheet discharge tray 71 in the stacked state.

(Restoring Operation From Drive Escape Mode After One Side Printing Operation)

Now, a description is given to a process for restoring drive connection for the relevant printing drum after the one side printing operation has been terminated. As shown in FIG. 5, when the both-face print button 95 is depressed (in step S4), the control section 97 checks whether the downstream printing drum 50 remains in the drive escape position (in step S5). When the downstream printing drum 50 is found to remain in the drive escape position, the main motor M is driven to allow the upstream printing drum 40 to be shifted to a reference position of the rotating phase with respect to the downstream printing drum 50 (in step S6). Subsequently, the drive escape motor 90 is driven to allow the printing drum 50 to move to the mounting position shown in FIG. 2A (in step S7), thereby completing the operation. The relative rotational phase between the upstream printing drum 40 and the downstream printing drum 50 is precisely adjusted with a rotational phase adjusting unit which is not shown.

(Operation During Drive Escape Mode)

During the aforementioned one side printing mode, the upper surface of the print sheet 45 is transferred with ink in the upstream printing section 4, with the print sheet 45, which is transferred with ink, being transferred with the upstream belt-conveyer transfer unit 7 to the position in the downstream printing section 5. When this takes place, the print sheet 45 passes through the space between the downstream printing drum 50, which is held stationary, and the press roller 56, which remains in the separated position, into the downstream belt-conveyer transfer unit 8, by which the print sheet 45 is further transferred to the sheet discharge section 9. As a result, it is possible for the stencil sheet 20', which has been made in the previous stencil making process, to remain in the mounted state on the printing drum 50, which remains in the drive escape position, thereby avoiding the need for mounting a non-perforated stencil sheet onto the printing drum 50. In addition, since the print sheet 45 is fed in the same transfer route as that prepared during the both sides printing mode while the printing drum 50 is not applied with rotational power and remains inoperative, the waste of the stencil sheet 20' is avoided and it is unnecessary to prepare an extra transfer unit in another route to transfer the stencil sheet during the one side printing mode, thereby enabling the one side printing operation without deterioration in the quality of ink.

In the illustrated embodiment described above, although the downstream printing drum 50 has been shown and described as being constructed to assume the drive escape position, the upstream printing drum 40 may be constructed so as to assume the drive escape position. That is, in a case where the upstream printing drum 40 is enabled to assume the drive escape position, the print sheet 45, which is fed from the paper feed section 6 during the one side printing mode, passes through the space between the upstream printing drum 40, which is held stationary, and the press roller 46, which remains in the separated position, and is received by the upstream belt-conveyer transfer unit 7 by which the print sheet 45 is further transferred to the position of the downstream printing section 5 to allow the lower surface of the print sheet 45 to be transferred with ink in the downstream printing section 5, with the print sheet 45, which has been transferred with ink, being transferred with the downstream belt-conveyer transfer mechanism 8 to the sheet discharge section 9.

With such a structure discussed above, similarly, the waste of the stencil sheet 20 is avoided and it is unnecessary to prepare an extra transfer unit in another route to transfer the stencil sheet during the one side printing mode, thereby enabling the one side printing operation without deterioration in the quality of ink. Also, both the upstream and downstream printing drums 40, 50 may be constructed so as to assume the respective drive escape positions to have respective structures one of which can be selected for performing the one side printing operation. With such structures, it becomes possible to freely select the surface (i.e., the upper surface or the lower surface) to be printed in the one side printing mode or the content (i.e., the image content of the upstream printing drum 40 or the image content of the downstream printing drum 50) to be printed.

In the illustrated embodiment discussed above, also, since the printing drum 50, which is enabled to shift to the drive escape position, is arranged to assume the drive escape position in the rotating angular position (i.e., the position shown in FIG. 6) wherein the printing drum 50 is brought into contact with the print sheet 45 at the area except the perforated area of the stencil sheet 20' and except the stencil clamping segment 51 that clamps the stencil sheet 20', it is possible for the print sheet 45 to pass without undesired contact with the perforated area of the stencil sheet 20', of the printing drum 50 which assumes the drive escape position, and the stencil clamping segment 51. As a consequence, the print sheet 45 is not adhered with ink and the stencil sheet clamping segment 51 does not become an obstacle for the transfer of the print sheet.

In the illustrated embodiment discussed above, further, since the printing drum 50, which is enabled to assume the drive escape position, is selected as the printing drum 50 that enables ink transfer to a particular surface, of the print sheet, which becomes the upper surface under a condition where the print sheet 45 is placed on the sheet discharge section, the print sheet 45 is transferred with its printed surface oriented upward, providing an ease of confirmation of the print contents, etc. to effectively prevent the printing operation in the reversed surface of the print sheet 45.

In the illustrated embodiment discussed above, also, since the printing drum 50, which is enabled to shift to the drive escape position, is provided in the downstream printing section 5, the paper feed section 6 is able to feed the print sheet 45 to the upstream printing section 4 at more accurate paper feed timing than that of the upstream transfer unit 7 to perform the printing operation on the print sheet, which has been fed at the accurate paper feed timing, in the upstream printing operation, thereby enabling the printed product to be obtained with a superb performance in the printing position. Also, the presence of the transfer passage in the extended length to the paper receiving tray 71 is effective for preventing the reversed surface of the print sheet 45 from being undesirably printed.

In the illustrated embodiment discussed above, also, the two upstream and downstream printing drums 40, 50 are rotated in synchronism with one another with rotational power of the main motor M, which is the single drive source, while maintaining the relative rotational phase difference. Thus, in the machine wherein the upstream and downstream printing drums 40, 50 are both rotated with rotational power of the single drive source, since the printing drum 50, which remains in the drive escape position, even when the drive source is controlled during the one side printing mode in the same manner as in the both sides printing mode, control in the one side printing mode may be easily performed. Also, in a case where the drive source for the upstream printing drum 40 and the drive source for the downstream printing drum 50 are separately located, control is required in different phases for the respective drive sources in the both sides printing mode and the one side printing mode, respectively.

In the illustrated embodiment discussed above, further, since the press roller 56 is shifted between the pressured position and the separated position relative to the printing drum 50, which can be shifted to the drive escape position, in association with the rotation of the printing drum 50, the presence of the printing drum 50 remaining in the drive escape position allows the press roller 56 to remain in the separated position, providing an ease of control for the one side printing operation. In a case where the press roller 56 is not associated in movement with the rotation of the printing drum 50 and the press roller 56 is shifted between the pressured position and the separated position in dependence on the rotational angular position of the printing drum 50, it is necessary to take a measure for the rotational angular phase for the drive escape position of the printing drum so as to allow the printing drum to perform the drive escape operation at a rotational angular position to render the press roller 56 to assume the separated position.

Still also, in the illustrated embodiment discussed above, although the present invention has been shown and described with reference to a case where the press rotational members are composed of the press rollers 46, 56 of a sufficiently smaller diameter than those of the printing drums 40, 50, the press rotational members may be of members which exert printing pressure against the printing drums 40, 50, respectively. For example, the press rotational members may be made of press drums of substantially the same diameter as those of the printing drums 40, 50.

Summarizing the above, an advantage of the present invention concerns the printing-drum drive escape mechanism which is able to shift either one of the printing drums of the upstream and downstream printing sections to the drive escape position to disenable the rotation of the either one of the printing drums while retaining the press rotary member, associated with the either one of the printing drums, in the separated position such that, when the one side printing mode is selected, the either one of the printing drums of the upstream and downstream printing sections remains in the drive escape position whereas the press rotary member associated with the either one of the printing drums is rendered to remain in the separated position. Thus, in a case where the downstream printing drum is enabled to assume the drive escape position, one surface of the print sheet is transferred with ink in the upstream printing section during the one side printing mode, with the print sheet, which has been transferred with ink, being transferred through the upstream belt-conveyer transfer unit to the downstream printing section to simply pass the print sheet through the downstream printing drum remaining in the non-rotatable position and the press rotary member remaining in the separated position to be received by the downstream belt-conveyer transfer unit by which the print sheet is then transferred to the sheet discharge section.

In a case where the upstream printing drum is rendered to remain in the drive escape position, further, the print sheet, which has been fed from the paper feed section during the one side printing mode, is allowed to merely pass through between the upstream printing drum remaining in the non-rotatable position and the press rotary member remaining in the separated position to be received by the upstream belt-conveyer transfer unit which then transfers the print sheet to the downstream printing section which transfer ink to the one surface of the print sheet which is then transferred with the downstream belt-conveyer transfer unit to the sheet discharge section.

Therefore, another advantage of the present invention concerns the presence of the printing drum which is enabled to remain in the drive escape position to allow the stencil sheet, which has been previously made, to remain on the printing drum to disenables the need for mounting the non-perforated stencil sheet onto the printing drum while permitting the print sheet to be transferred in the same route as that provided in the both sides printing mode, thereby preventing the waste of the stencil sheet while disenabling the need for providing the extra transfer route specific for the one side printing operation and enabling the one side printing operation without causing a deterioration in the quality of ink.

Also, another advantage of the present invention involves a specific operating condition of the printing drum which is arranged to assume the drive escape position under the condition wherein the print sheet is brought into contact with the printing drum at the area except for the perforated area of the stencil sheet and at the area except for the stencil clamping segment that clamps the stencil sheet. As a result, the print sheet is able to pass through the printing section without contact with the perforated area of the stencil sheet mounted to the printing drum which remains in the drive escape position or with the stencil clamping segment, thereby preventing ink to be adhered to the print sheet while preventing the transfer of the print sheet from being suffered with the stencil clamping segment serving as the obstacle.

Another advantage of the present invention also concerns the printing drum, which is enabled to shift to the drive escape position, allowing the surface, which will face upward in the stacked state on the sheet discharge section, of the print sheet to be transferred with ink, thereby allowing the print sheet to be discharged with its printed surface facing upward to provide an ease of confirmation for the printed content for thereby effectively preventing the reversed surface of the print sheet from being undesirably printed.

Another advantage of the present invention also concerns the printing drum, which is enabled to shift to the drive escape position, of the downstream printing section to allow the paper feed section to feed the print sheet to the upstream printing section at more accurate paper feed timing than that of the upstream transfer unit to perform the printing operation on the print sheet, which has been fed at the accurate paper feed timing, in the upstream printing operation, thereby enabling the printed product to be obtained with a superb performance in the printing position. Also, the presence of the transfer passage in the extended length to the sheet discharge section is effective for preventing the reversed surface of the print sheet from being undesirably printed.

Another advantage of the present invention also concerns the two printing drums of the upstream and downstream printing sections arranged to rotate in synchronism with one another during the both sides printing mode while maintaining the relative rotational angular phase with rotational power of the single drive source such that, in a printing machine wherein both the printing drums of the upstream and downstream printing sections are rotated with rotational power of the single drive source, even when the drive condition of the drive source is controlled during the one side printing mode in the same manner as in the both sides printing mode, the printing drum remaining in the drive escape position is rendered non-operative, thereby providing an ease of control in the one side printing operation.

Still also, another advantage of the present invention concerns the press rotary member, associated with the printing drum which can be shifted to the drive escape position, which is arranged to shift between the pressured position and the separated position in association with the rotation of the aforementioned printing drum, allowing the press rotary member, which opposes to the printing drum, to remain in the separated position by rendering the printing drum, which is able to assume the drive escape position, to remain in the drive escape condition for thereby providing an ease of control in the one side printing operation.

The entire content of a Patent Application No. TOKUGAN 2000-302473 with a filing date of Oct. 2, 2000 in Japan is hereby incorporated by reference.

Although the invention has been described above by reference to a certain embodiment of the invention, the invention is not limited to the embodiment described above. Modifications and variations of the embodiment described above will occur to those skilled in the art, in light of the teachings. The scope of the invention is defined with reference to the following claims.

What is claimed is:

1. A stencil printing machine selectively carrying out a printing operation in a both sides printing mode and in a one side printing mode, comprising:

an upstream printing section including a first printing drum formed with an ink permeable outer peripheral wall adapted to be mounted with a stencil sheet, a first ink supply unit supplying ink to an inner periphery of the first printing drum, and a first press rotary member operative to be held in a pressured position in contact with the outer peripheral wall of the first printing drum to allow ink to be transferred onto one surface of a print medium;

a downstream printing section including a second printing drum formed with an ink permeable outer peripheral wall adapted to be mounted with a stencil sheet, a second ink supply unit supplying ink to an inner periphery of the second printing drum, and a second press rotary member operative to be held in a pressured position in contact with the outer peripheral wall of the second printing drum to allow ink to be transferred onto the other surface of the print medium;

a paper feed section feeding the print medium to the upstream printing section; and a printing-drum drive escape mechanism operative to shift either selected one of the first and second printing drums into a drive escape position to interrupt rotation of the selected printing drum while retaining either selected one, associated with the selected printing drum, of the first and second press rotary members in a separated position to pass the print medium into a sheet discharge section along the selected printing drum without contact with the selected press rotary member, in the one side printing mode.

2. The stencil printing machine according to claim 1, further comprising:

an upstream transfer unit transferring the print medium, discharged from the upstream printing section, to be fed to the downstream printing section; and a downstream transfer unit transferring the print medium, discharged from the downstream printing section, to be fed to the sheet discharge section.

3. The stencil printing machine according to claim 1, wherein the selected printing drum remains in the drive escape position at a rotational angular position where the print medium is held in contact with the selected printing drum in an area except for a perforated area of the stencil sheet and a stencil clamping area of the selected printing drum.

4. The stencil printing machine according to claim 1, wherein the selected printing drum functions to transfer ink to a surface, which serves as an upper surface when placed in a stacked state in the sheet discharge section, of the print medium.

5. The stencil printing machine according to claim 1, wherein the second printing drum is selected to be operated with the printing-drum drive escape mechanism in the one side printing mode.

6. The stencil printing machine according to claim 1, further comprising a single drive source rotating the first printing drum and the second printing drum in synchronism with each other while retaining a relative rotational angular phase difference in the both sides printing mode.

7. The stencil printing machine according to claim 1, wherein the selected press rotary member associated with the selected printing drum is able to shift between the pressured position and the separated position in association with-rotation of the selected printing drum.

8. A method of selectively carrying out a printing operation in a both sides printing mode and in a one side printing mode, comprising:

providing an upstream printing section including a first printing drum and a first press rotary member operative to shift between a pressured position and a separated position relative to the first printing drum;

providing a downstream printing section including a second printing drum and a second press rotary member operative to shift between a pressured position and a separated position relative to the second printing drum;

providing a printing-drum drive escape mechanism operative to enable a shift of either selected one of the first and second printing drums into a drive escape position;

feeding a print medium to the upstream printing section; and feeding the print medium, which is discharged from the first printing drum of the upstream printing section, to the downstream printing section, wherein, when the one side printing mode is selected, the printing-drum drive escape mechanism is operative to shift either selected one of the first and second printing drums to the drive escape position to render the selected printing drum inoperative and to render the selected press rotary member to remain in the separated position away from the selected printing drum to pass the print medium into a sheet discharge section along the selected printing drum without contact with the selected press rotary member, in the one side printing mode.

* * * * *